US009569903B2

(12) United States Patent
Funayama

(10) Patent No.: US 9,569,903 B2
(45) Date of Patent: Feb. 14, 2017

(54) VEHICLE CONTROL APPARATUS

(71) Applicant: Toyota Jidosha Kabushiki Kaisha, Toyota-shi (JP)

(72) Inventor: Tomoyuki Funayama, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/751,534

(22) Filed: Jun. 26, 2015

(65) Prior Publication Data

US 2016/0042580 A1 Feb. 11, 2016

(30) Foreign Application Priority Data

Aug. 8, 2014 (JP) ..... 2014-162728

(51) Int. Cl.
*G07C 9/00* (2006.01)
*E05F 15/77* (2015.01)
*E05F 15/76* (2015.01)

(52) U.S. Cl.
CPC ..... *G07C 9/00007* (2013.01); *E05F 15/76* (2015.01); *E05F 15/77* (2015.01); *G07C 9/00309* (2013.01);
(Continued)

(58) Field of Classification Search
CPC . B60R 25/24; G07C 2209/63; G07C 9/00309; G07C 2009/00769; G07C 9/00007; E05F 15/77; E05F 15/76; E05Y 2900/50; E05Y 2900/531
See application file for complete search history.

(56) References Cited

U.S. PATENT DOCUMENTS 5,499,022 A 3/1996 Boschini
5,912,631 A 6/1999 Kusunoki
(Continued)

FOREIGN PATENT DOCUMENTS

CN 1971632 A 5/2007
EP 1820704 A1 8/2007
(Continued)

OTHER PUBLICATIONS

Office Action issued on Mar. 26, 2012 in U.S. Appl. No. 12/550,887.
(Continued)

*Primary Examiner* — Yuen Wong
(74) *Attorney, Agent, or Firm* — Oblon, McClelland, Maier & Neustadt, L.L.P.

(57) ABSTRACT

A vehicle control apparatus is disclosed, which includes an actuator that is provided on a vehicle and performs a door closing operation of the vehicle; a reservation part; a storage part that stores reservation information; a portable terminal; a communication apparatus that is provided on a vehicle to bi-directionally communicate with the portable terminal; and a controller that causes, when the reservation information is stored in the storage part, the actuator to start the door closing operation when a distance between the communication apparatus and the portable terminal is within a first predetermined range, and causes, during the door closing operation of the door, the actuator to stop the door closing operation when the distance is within a second predetermined range that is adjacent to the first predetermined range.

8 Claims, 6 Drawing Sheets

(52) U.S. Cl.
CPC ..... *E05Y 2900/50* (2013.01); *E05Y 2900/531* (2013.01); *G07C 2009/00769* (2013.01)

(56) References Cited

U.S. PATENT DOCUMENTS

| | | | | |
|---|---|---|---|---|
| 6,906,612 | B2 * | 6/2005 | Ghabra | B60R 25/24 340/5.61 |
| 7,181,189 | B2 | 2/2007 | Hotta et al. | |
| 8,089,342 | B2 | 1/2012 | Sugiura et al. | |
| 2003/0014164 | A1 | 1/2003 | Shin | |
| 2003/0216817 | A1 * | 11/2003 | Pudney | E05B 81/78 700/17 |
| 2004/0203630 | A1 | 10/2004 | Wang | |
| 2006/0279402 | A1 | 12/2006 | Okamitsu et al. | |
| 2007/0120645 | A1 * | 5/2007 | Nakashima | G07C 9/00309 340/5.61 |
| 2008/0114539 | A1 | 5/2008 | Lim | |
| 2008/0157919 | A1 | 7/2008 | Sugiura et al. | |
| 2009/0096578 | A1 | 4/2009 | Ogino et al. | |
| 2010/0050713 | A1 * | 3/2010 | Nagao | B60R 25/2036 70/255 |
| 2010/0073153 | A1 | 3/2010 | Yamaguchi et al. | |

FOREIGN PATENT DOCUMENTS

| | | |
|---|---|---|
| JP | H05-156851 | 6/1993 |
| JP | H11-117586 | 4/1999 |
| JP | 2000-145228 | 5/2000 |
| JP | 2003-148019 | 5/2003 |
| JP | 2004-19380 | 1/2004 |
| JP | 2005-097860 | 4/2005 |
| JP | 2005-521299 | 7/2005 |
| JP | 2005-207223 | 8/2005 |
| JP | 2007-107343 | 4/2007 |
| JP | 2007-107344 | 4/2007 |
| JP | 2007-217968 | 8/2007 |
| JP | 2007-303254 | 11/2007 |
| JP | 2008-125087 | 5/2008 |
| JP | 2008-163633 | 7/2008 |
| JP | 2010-077665 | 4/2010 |
| JP | 2010-077666 | 4/2010 |
| JP | 2010-077887 | 4/2010 |
| JP | 4488050 | 4/2010 |
| JP | 2011-247076 | 12/2011 |
| JP | 2012-102585 | 5/2012 |
| JP | 2015-132130 | 7/2015 |
| WO | WO 2014/125650 A1 | 8/2014 |

OTHER PUBLICATIONS

Office Action issued on Sep. 30, 2013 in U.S. Appl. No. 12/550,887.

* cited by examiner

VEHICLE CONTROL APPARATUS

FIELD

The disclosure is related to a vehicle control apparatus.

BACKGROUND

A configuration is known from Japanese Laid-open Patent Publication No. 2012-102585 (referred to as "Patent Document 1" hereinafter) in which a portable machine of a keyless entry system for a vehicle includes: a drive reservation setting part for setting drive reservation for shifting a door of a vehicle to a closed state or an open state by an operation by a user; a delay time generation part for generating predetermined delay time with the point of time of setting the drive reservation as a reference on the basis of the set drive reservation, and a transmission control part that executes control so as to transmit a control signal for shifting the door of the vehicle to the closed state from a transmission part only for a predetermined transmission period after the lapse of the delay time after the drive reservation is set.

In a configuration disclosed in Patent Document 1, shifting the door of the vehicle to the closed state is not performed prior to the lapse of the delay time, even if a user who finishes picking up baggage through the door of the vehicle and thus desires the door of the vehicle to be shifted in closed state prior to the lapse of the delay time. Further, because the door of the vehicle is shifted to the closed state after the lapse of the delay time, the user has to finish picking up the baggage through the door of the vehicle prior to the lapse of the delay time.

Regarding this problem, there may be such a solution, in terms of increasing convenience, that a closing operation of the door by an actuator is started, if reservation information is stored, upon a distance between a portable terminal and the vehicle being greater than or equal to a predetermined distance. According to the solution, the problems that occur in the configuration disclosed in Patent Document 1 can be solved, because the closing operation of the door can be started based on the reservation information upon the distance between the portable terminal and the vehicle being within an appropriate range.

However, according to the solution, once the closing operation of the door is started based on the reservation information, the closing operation of the door is continued afterward regardless of a change in the portable terminal and the vehicle, which leads to the following problems. For example, if the user comes closer to the door that is being closed after the closing operation of the door is started based on the reservation information, there is a probability that the user has an intention to stop the closing operation of the door in progress. In such a case, continuing the closing operation of the door may be against the user's intention. Alternatively, if the user goes away from the door that is being closed after the closing operation of the door is started based on the reservation information, there is a probability that the user does not confirm that the closing operation is completed safely.

Therefore, an object of the disclosure is to provide a vehicle control apparatus that can appropriately stop a closing operation of a door of a vehicle according to a distance between a communication apparatus and a portable terminal.

SUMMARY

According to one aspect of the disclosure, a vehicle control apparatus is provided, which includes:

an actuator that is provided on a vehicle and performs a door closing operation of the vehicle;

a reservation part that generates reservation information that identifies a reservation for the door closing operation by the actuator;

a storage part that stores the reservation information;

a portable terminal;

a communication apparatus that is provided on a vehicle to bi-directionally communicate with the portable terminal; and a controller that causes, when the reservation information is stored in the storage part, the actuator to start the door closing operation when a distance between the communication apparatus and the portable terminal is within a first predetermined range, and causes, during the door closing operation of the door, the actuator to stop the door closing operation when the distance is within a second predetermined range that is adjacent to the first predetermined range.

DESCRIPTION OF EMBODIMENTS

In the following, embodiments are described in detail with reference to appended drawings.

Figure 1:
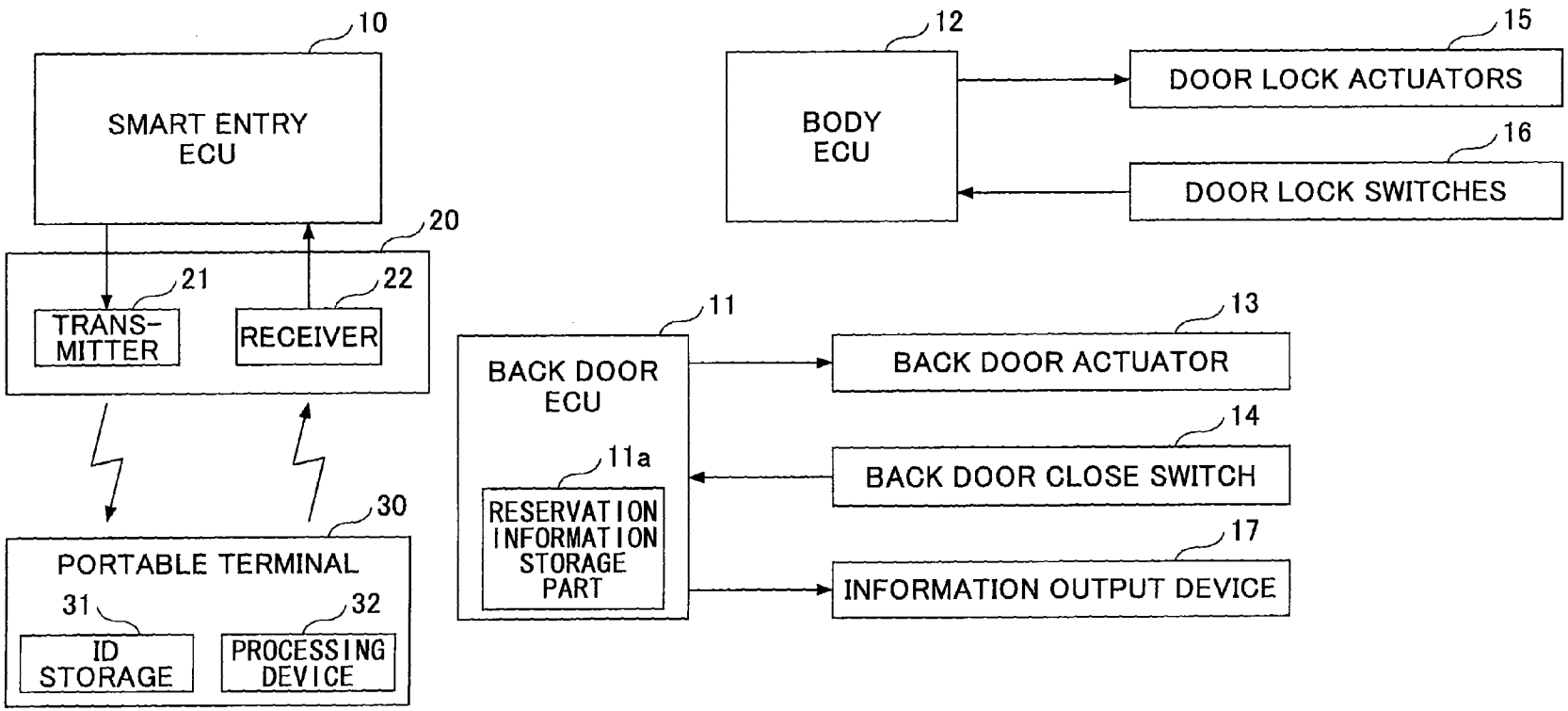
FIG. 1 is a diagram schematically illustrating an example of a system including a vehicle control apparatus 1.

FIG. 1 is a diagram schematically illustrating an example of a system including a vehicle control apparatus 1.

The vehicle control apparatus 1 includes a smart entry ECU 10 (referred to as "a smart ECU" hereinafter), a body ECU 12, a back door ECU 11, a back door actuator 13, a reservation information storage part 11*a*, a communication apparatus 20, a portable terminal 30, and a back door close switch (an example of a reservation part) 14.

The smart ECU 10 includes a microprocessor that includes a CPU, a ROM, a RAM, etc., which are interconnected via buses (not illustrated). In the ROM are stored the computer readable programs to be carried out by the CPU. The function of the smart ECU 10 may be implemented by hardware, software, firmware, or any combination thereof.

The smart ECU 10 is connected to the communication apparatus 20. The communication apparatus 20 includes a transmitter 21 and a receiver 22. The communication apparatus 20 bi-directionally communicates with the portable terminal 30.

Figure 2:
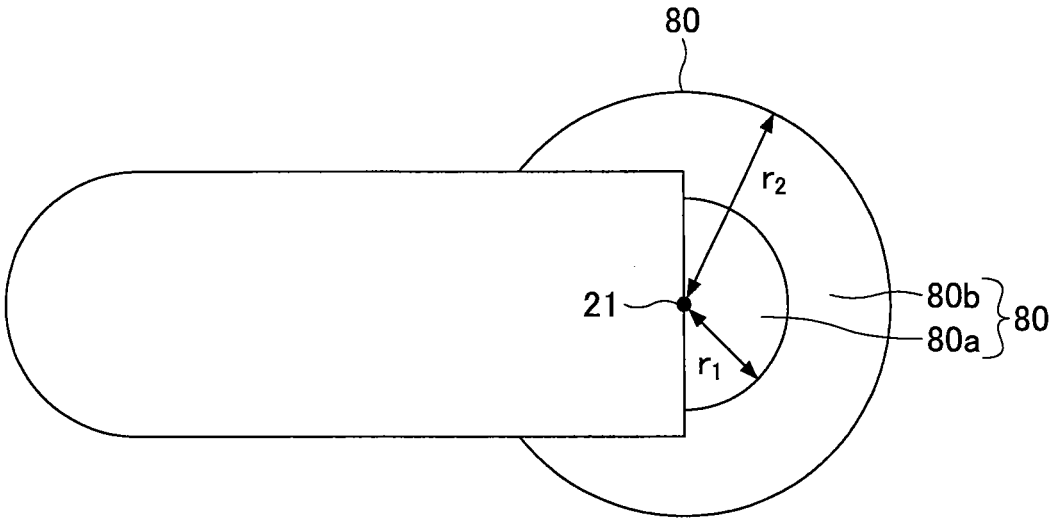
FIG. 2 is a diagram for illustrating an example of a detection area.

The transmitter 21 includes a transmission antenna to transmit a detection signal to an outside of a vehicle. For example, the detection signal transmitted from the transmitter 21 to the outside of the vehicle is received by the portable terminal 30. In the example illustrated in FIG. 2, the transmitter 21 is provided to cover outside space related to a back door (including a trunk and a luggage door). In FIG. 2, a state in which a detection area 80 is formed by the transmitter 21 is illustrated. The detection area 80 corresponds to an area in which the detection signal transmitted from the transmitter 21 is normally received by the portable terminal 30. Further, the detection area 80 includes a detection area 80*a* in which a distance from the transmitter 21 is less than or equal to a predetermined distance r1 and a detection area 80*b* in which a distance from the transmitter 21 is greater than the predetermined distance r1 and less than or equal to a predetermined distance r2. It is noted that the predetermined distance r1 may be adapted to correspond to a distance which can reflect an intention of a user who desires to stop the closing operation of the back door, such as a distance at which the user with the portable terminal 30 can reach the back door, etc., or may be a variable that can be set by the user. Further, the predetermined distance r2 may be adapted to correspond to a distance at which the user can easily confirm the safe completion of the closing operation of the back door, or may be a variable that can be set by the user. Further, the transmitter 21 may be embedded in a handle of the back door, for example. It is noted that a part of a function of the transmitter 21 may be implemented by the smart ECU 10.

The receiver 22 receives a response signal from the portable terminal 30. The receiver 22 is disposed at such a place where the receiver 22 can receive the response signal from the portable terminal 30. For example, the receiver 22 may be disposed on a side of a back seat of the vehicle. The receiver 22 may include an additional receiver disposed in the luggage space. The number and the location of the receiver 18 may be arbitrary. When the receiver 22 receives the response signal from the portable terminal 30, the receiver 18 performs processes such amplification, demodulation, etc., of the response signal received from the portable terminal 30, and transmits the demodulated response signal to the smart ECU 10. The smart ECU 10 compares an ID code included in the received response signal with an ID code stored in a predetermined storage (not illustrated). If the ID code included in the received response signal matches the ID code stored in the predetermined storage, it is determined that authentication of the portable terminal 30 is obtained and the portable terminal 30 exists in the detection area 80. On the other hand, if the ID code included in the received response signal does not match the ID code stored in the predetermined storage, or if the response signal is not supplied to the smart ECU 10, the smart ECU 10 determines that there is no portable terminal in the detection area 80. In this way, the smart ECU 10 outputs a determination result about whether the portable terminal 30 exists in the detection area 80.

Further, if the ID code included in the received response signal matches the ID code stored in the predetermined storage, the smart ECU 10 compares information of a reception strength of the detection signal, which is received by the portable terminal 30 and included in the detection signal, with a strength threshold stored in a predetermined storage to output the comparison result. The reception strength is proportional to a distance between the transmitter 21 and the portable terminal 30 such that the reception strength becomes lower as the distance between the transmitter 21 and the portable terminal 30 becomes greater. When the portable terminal 30 does not receive the detection signal, the reception strength is 0. If the reception strength is less than the strength threshold, it indicates that the portable terminal 30 exists in the detection area 80*b*, while if the reception strength is greater than or equal to the strength threshold, it indicates that the portable terminal 30 exists in the detection area 80*a*. It is noted that a part of a function of the transmitter 22 may be implemented by the smart ECU 10. By using the reception strength to determine whether the portable terminal 30 exists in the detection area 80*a* or in the detection area 80*b*, a simple configuration can be implemented.

The portable terminal 30 receives the detection signal and transmits the response signal. In the example illustrated in FIG. 1, the portable terminal 30 includes a transmitter-receiver (transponder) that performs bi-directional communication with the transmitter 21 and the receiver 22, and a transmitter-receiver antenna. Further, the portable terminal 30 includes an ID storage 31 that stores a given valid ID code and a processing device 32 that performs various processes. The processing device 32 performs calculation of the reception strength of the detection signal that is transmitted via a detection antenna of the transmitter 21 and received by the portable terminal 30. Further, when the portable terminal 30 receives the detection signal transmitted via the detection antenna, the portable terminal 30 transmits the response signal according to the detection signal. In this response signal, information related to the ID code and the reception strength of the detection signal are included.

The smart ECU 10 is connected to the back door ECU 11. The back door ECU 11 includes a microprocessor that includes a CPU, a ROM, a RAM, etc., which are interconnected via buses (not illustrated). In the ROM are stored the computer readable programs to be carried out by the CPU. The function of the smart ECU 11 may be implemented by hardware, software, firmware, or any combination thereof. Further, a part of or all of the functions of the smart ECU 10 may be implemented by the back door ECU 11 or other ECU(s). Reversely, a part of or all of the functions of the back door ECU 11 may be implemented by the smart ECU 10 or other ECU(s).

The back door ECU 11 is connected to the back door actuator 13 that implements the closing operation of the back door. In the example illustrated in FIG. 1, the back door actuator 13 drives to open or close the back door according to instructions from the back door ECU 11.

The back door ECU 11 includes the reservation information storage part 11*a*. The reservation information storage part 11*a* stores, upon a predetermined condition being met, reservation information that identifies a reservation for the operation by the back door actuator 13. An example of storing the reservation information by the reservation information storage part 11*a* is described hereinafter with reference to FIG. 3, etc.

The back door ECU 11 is connected to a back door close switch 14 that is an example of a switch to be operated for the closing operation of the back door. In the example illustrated in FIG. 1, the back door close switch 14 is operated by the user for the closing operation of the back door. Further, the back door close switch 14 also functions as reservation means as described hereinafter. The back door close switch 14 may be a mechanical switch or a touch switch. According to the operation on the back door close switch 14, the back door ECU 11 controls the back door actuator 13 or stores the reservation information in the reservation information storage part 11*a* (see FIG. 3, etc.).

It is noted that the back door close switch 14 may be disposed at an arbitrary place, and may be disposed at a plurality of places. For example, the back door close switches 14 may be disposed at three locations, that is to say, in the cabin, in the portable terminal 30, and at the back door.

In the following, unless otherwise specified, it is assumed that the back door close switch 14 is provided at the back door.

The back door ECU 11 is connected to an information output device 17 (an example of a first information output part, a second information output part and a third information output part). The back door ECU 11 controls the information output device 17 to output various items of the information for the user. It is noted that the information output device 17 may be a speaker or the like that outputs the information with sound such as speech, alarm sound, etc., a display or the like that visually outputs the information with an image, etc., or a combination thereof.

The smart ECU 10 and the back door ECU 11 are connected to the body ECU 12. The body ECU 12 includes a microprocessor that includes a CPU, a ROM, a RAM, etc., which are interconnected via buses (not illustrated). In the ROM are stored the computer readable programs to be carried out by the CPU. The function of the body ECU 12 may be implemented by hardware, software, firmware, or any combination thereof. Further, a part of or all of the functions of the smart ECU 10 or the back door ECU 11 may be implemented by the body ECU 12 or other ECU(s). Reversely, a part of or all of the functions of the body ECU 12 may be implemented by the smart ECU 10, the back door ECU 11 or other ECU(s).

The body ECU 12 is connected to door lock actuators 15. The door lock actuators 15 drive door lock mechanisms according to instructions from the body ECU 12 to lock and unlock the doors.

The body ECU 12 is connected to door lock switches 16. The body ECU 12 may control the door lock actuators 15 based on the operation on the door lock switches 16.

Next, a reservation function of the reservation information storage part 11*a* for storing the reservation information is described.

Figure 3:
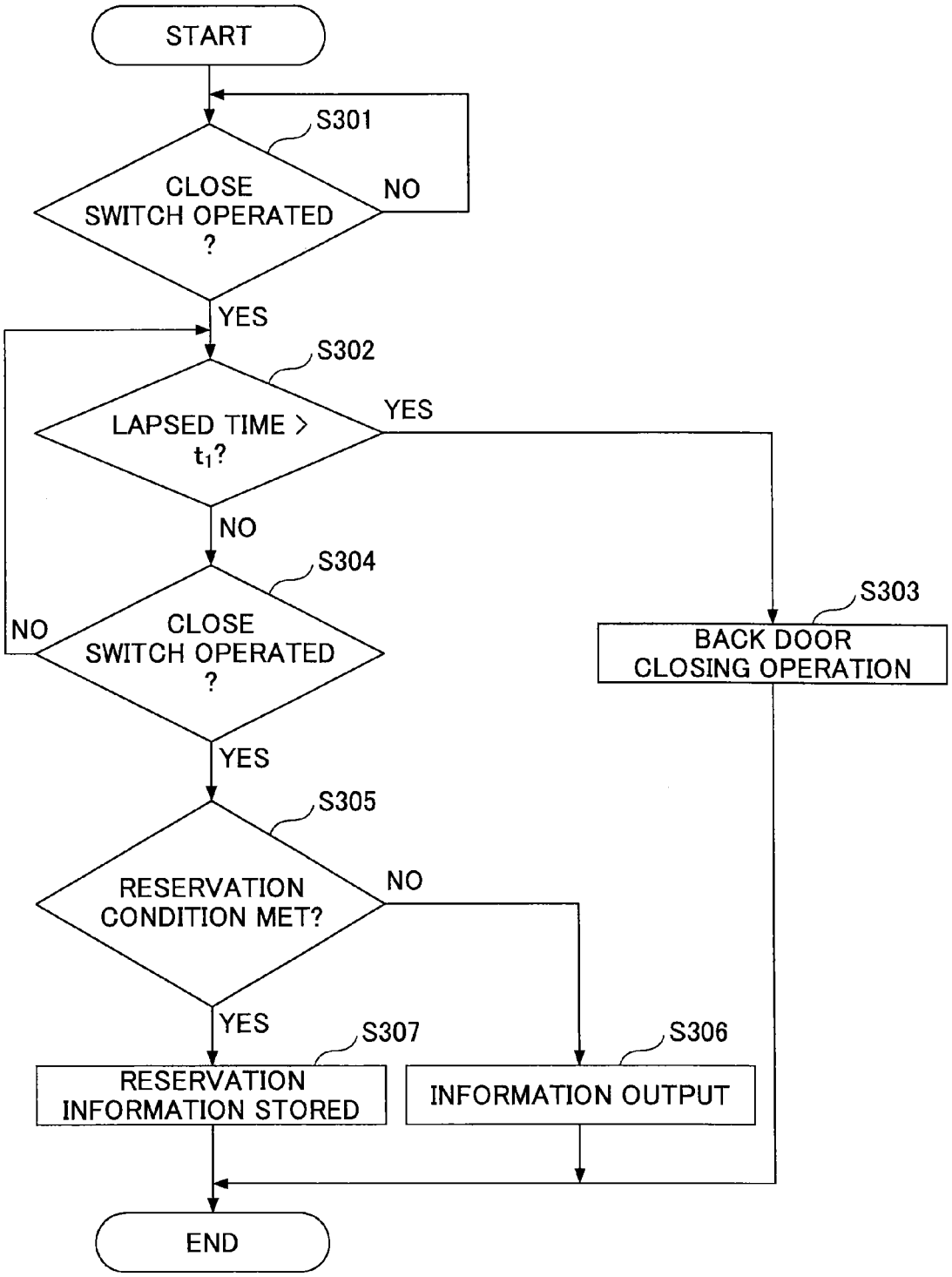
FIG. 3 is a flowchart of an example of a process executed by a back door ECU 11 and related to a reservation function of a back door close switch 14.

FIG. 3 is a flowchart of an example of a process executed by the back door ECU 11 related to a reservation function of the back door close switch 14.

In step S301, the back door ECU 11 determines whether the back door close switch 14 is operated. If it is determined that the back door close switch 14 is operated, the process routine goes to step S302.

In step S302, the back door ECU 11 determines whether a lapsed time from the timing when it is determined in step S301 that the back door close switch 14 is operated is greater than a predetermined time t1 (an example of a first predetermined time). The predetermined time t1 is used to detect successive operations of the back door close switch 14 and thus may be relatively short (1 second, for example). If it is determined that the lapsed time is greater than the predetermined time t1, the process routine goes to step S303. Further, if it is determined that the lapsed time is not greater than the predetermined time t1, the process routine goes to step S304.

In step S303, the back door ECU 11 causes the back door actuator 13 to close the back door. It is noted that if the back door has already been in the closed state, the process of step S303 is skipped.

In step S304, the back door ECU 11 determines whether the back door close switch 14 is operated again after it is determined that the back door close switch 14 is operated in step S301. If it is determined that the back door close switch 14 is operated again, the back door ECU 11 determines that the back door close switch 14 has generated the reservation information and the process routine goes to step S305. Otherwise, the process routine returns to step S302. Specifically, the back door ECU 11 determines that the back door close switch 14 has generated the reservation information upon an operation (an example of the reservation operation) of the user operating (pressing) the back door close switch 14 again within a predetermined time after the previous operation of operating (pressing) the back door close switch 14. In this case, the reservation information corresponds to a combination of two successive ON signals generated by the back door close switch 14.

In step S305, the back door ECU 11 determines whether a condition required to be met to store the reservation information in the reservation information storage part 11*a* is met. For example, the condition required to be met to store the reservation information is such that all the following condition factors are met.

(a) Ignition switch is in an OFF state.
(b) vehicle speed is 0.
(c) shift is in a parking range.
(d) back door is in opened state.
(e) doors other than the back door are in closed state.
(f) a distance between the portable terminal 30 and the transmitter 21 is less than or equal to the predetermined distance r1.

The condition required to be met to store the reservation information is not limited to the ones described above, and may be different. It is noted that, because of the existence of the condition factor "doors other than the back door are in closed state", it is necessary for the doors other than the back door to be in the closed state in order to have the reservation information stored in the reservation information storage part 11*a*. For this reason, in a state where any door other than the back door is in the opened state, the reservation information does not cause the back door actuator 13 to drive the back door to implement the closing operation of the back door. As a result of this, a probability that the user goes away from the vehicle without noticing the state where any door other than the back door is in the opened state after the user has implemented the closing operation of the back door with the reservation information can be reduced. Further, the condition factor "the distance between the portable terminal 30 and the transmitter 21 is less than or equal to the predetermined distance r1" is met when the user operates the back door close switch 14 provided at the back door. In the case of the operation on other back door close switches 14, the condition factor "the distance between the portable terminal 30 and the transmitter 21 is less than or equal to the predetermined distance r1" may be omitted. If it is determined that the condition required to be met to store the reservation information is not met, the process routine goes to step S306. If it is determined that the condition required to be met to store the reservation information is met, the process routine goes to step S307.

In step S306, the back door ECU 11 does not store the reservation information generated by the back door close switch 14 and controls the information output device 17 to output the information indicating that the condition to be met to store the reservation information is not met. For example, if it is determined that any door other than the back door is in the opened state, the information is output to inform the user that a door other than the back door is in the opened state. As a result of this, the user can recognize that the reservation information has not been successfully stored. It is noted that a way of outputting the information by the information output device 17 may be varied according to the condition factor(s) that is not met such that the user can understand which condition factor(s) is not met to store the reservation information, or may be the same regardless of the condition factor(s) that is not met. If the way of outputting the information is varied according to the condition factor(s) that is not met, the user can understand the reason why the reservation information has not been successfully stored when such a case occurs.

In step S307, the back door ECU 11 causes the reservation information storage part 11*a* to store the reservation information generated by the back door close switch 14. However, the reservation information stored in the reservation information storage part 11*a* is not necessarily the same as the reservation information generated by the back door close switch 14, and may be in a converted form (an on/off state of a reservation flag, for example). The back door ECU 11 controls the information output device 17 to output the information to inform the user that the reservation information is stored in the reservation information storage part 11*a*. By outputting the information indicating that the reservation information is stored, the user can recognize that the reservation information is stored. It is noted that outputting the information indicating that the reservation information is stored may be performed once when the reservation information is stored in the reservation information storage part 11*a*, or may be performed constantly during the period in which the reservation information is stored in the reservation information storage part 11*a*.

In this way, according to the process illustrated in FIG. 3, the user can have the reservation information stored in the reservation information storage part 11*a* by successively operating the back door close switch 14 to generate the reservation information under a situation where the reservation condition is met. Thus, by utilizing the back door close switch 14, the reservation information can be stored in the reservation information storage part 11*a* without providing another new switch dedicated for the reservation.

It is noted that if the reservation information is stored in the back door ECU 11 using the back door close switch 14 other than the back door close switch 14 provided at the back door, such as the back door close switch 14 in the cabin, the processes of step S305 and step S306 may be omitted in the process illustrated in FIG. 3. In this case, it is possible to have the reservation information stored in the reservation information storage part 11*a* in advance during the trip of the vehicle, for example. Alternatively, the condition of step S305 may be changed if necessary.

Figure 4:
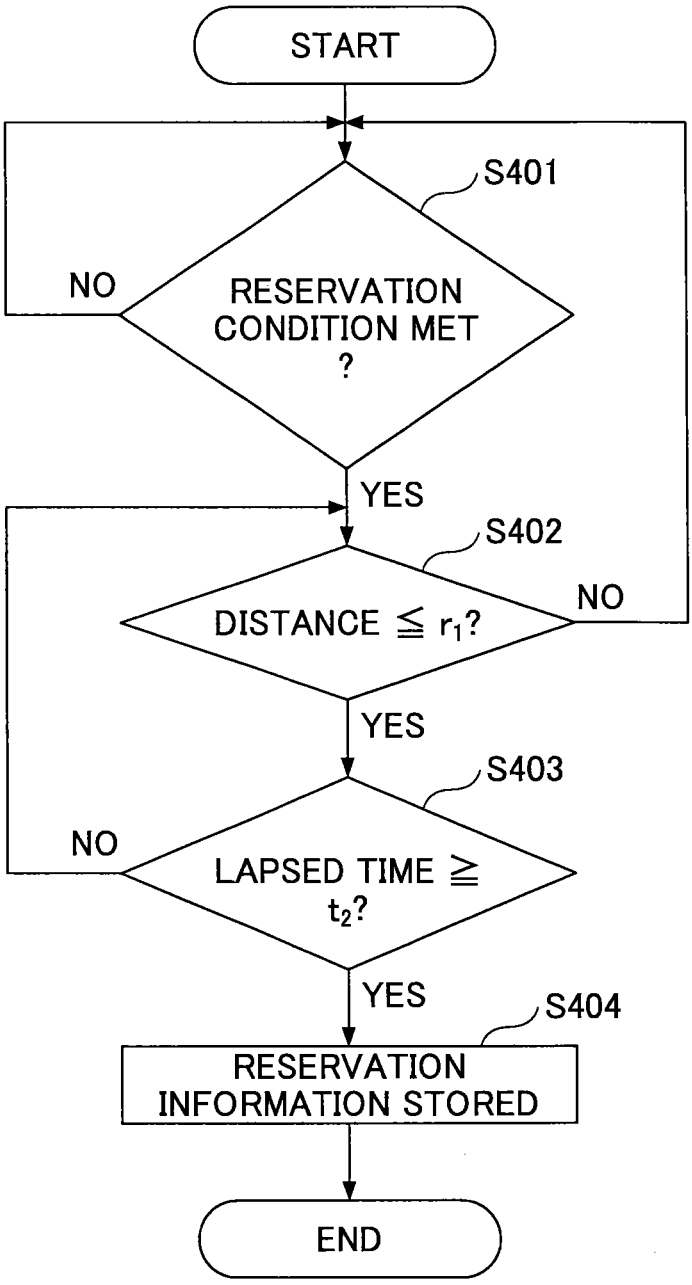
FIG. 4 is a flowchart of an example of a process executed by the back door ECU 11 and related to a reservation function of a smart ECU 10.

FIG. 4 is a flowchart of another example of a process executed by the back door ECU 11 and related to the reservation function. In the process illustrated in FIG. 4, the back door ECU 11 functions as the reservation means to automatically generate the reservation information. The process illustrated in FIG. 4 may be performed in addition to or instead of the process illustrated in FIG. 3. It is noted that the process illustrated in FIG. 4 may be constantly performed during the period in which the reservation information is not stored in the reservation information storage part 11*a*, for example.

In step S401, the back door ECU 11 determines whether a condition required to be met to store the reservation information in the reservation information storage part 11*a* is met. The condition required to be met to store the reservation information differs from the condition explained with reference to step S305 in FIG. 3 only in that the condition factor "the distance between the portable terminal 30 and the transmitter 21 is less than or equal to a predetermined distance r1" is removed, and thus the further explanation is omitted. If it is determined that the condition required to be met to store the reservation information is met, the process routine goes to step S402, otherwise the process routine starts from step S401 at the next process cycle.

In step S402, the back door ECU 11 determines whether the distance between the portable terminal 30 and the transmitter 21 is less than or equal to the predetermined distance r1. The output of the smart ECU 10 described above (the determination result concerning whether the portable terminal 30 exists in the detection area 80, and the comparison result between the reception strength and the strength threshold) is input to the back door ECU 11. If the portable terminal 30 exists in the detection area 80 and the reception strength is greater than or equal to the strength threshold, it means that the portable terminal 30 exists in the detection area 80*a*. Thus, in this case, the back door ECU 11 determines that the distance between the portable terminal 30 and the transmitter 21 is less than or equal to the predetermined distance r1. On the other hand, if the portable terminal 30 does not exist in the detection area 80 and the reception strength is less than the strength threshold, it means that the portable terminal 30 does not exist in the detection area 80*a*. Thus, in this case, the back door ECU 11 determines that the distance between the portable terminal 30 and the transmitter 21 is not less than or equal to the predetermined distance r1. It is noted that in step S401 described above the back door ECU 11 may send a request to the smart ECU 10 for the determination result and the comparison result upon it being determined that the condition to be met to store the reservation information is met, and the smart ECU 10 may periodically transmit the detection signal upon the reception of the request from the back door ECU 11 to output the determination result and the comparison result. Alternatively, the smart ECU 10 may constantly and periodically transmit the detection signal upon the reception of the request from the back door ECU 11 to output the determination result and the comparison result. If it is determined that the distance between the portable terminal 30 and the transmitter 21 is less than or equal to r1, the process routine goes to step S403, otherwise the process routine goes to step S401.

In step S403, it is determined whether the lapsed time from the timing when it is determined for the first time in step S402 that the distance between the portable terminal 30 and the transmitter 21 is less than or equal to r1 is greater than or equal to a predetermined time t2. The predetermined time t2 is used for transmitting the intention of the user for having the reservation information stored in the reservation information storage part 11*a* to the back door ECU 11. If it is determined that the lapsed time from the timing when it is determined for the first time in step S402 that the distance between the portable terminal 30 and the transmitter 21 is less than or equal to r1 is greater than or equal to the predetermined time t2, the process routine goes to step S404, otherwise the process routine returns to step S402.

In step S404, the back door ECU 11 generates the reservation information to have the reservation information stored in the reservation information storage part 11*a*. The process of step S404 is substantially the same as the process of step S307 in FIG. 3 except for a generation source for the reservation information, and thus the explanation thereof is omitted.

In this way, according to the process illustrated in FIG. 4, the user can have the reservation information stored in the reservation information storage part 11*a* by staying at the location where the distance between the portable terminal 30 and the transmitter 21 is less than or equal to the predetermined distance r1 for greater than or equal to the predetermined time t2 under a situation where the reservation condition is met. Thus, it is possible to have the reservation information stored in the reservation information storage part 11*a* without providing a new switch dedicated for the reservation and requiring the user any special operation.

Next, a closing operation interruption function implemented by the back door ECU 11 is described.

Figure 5:
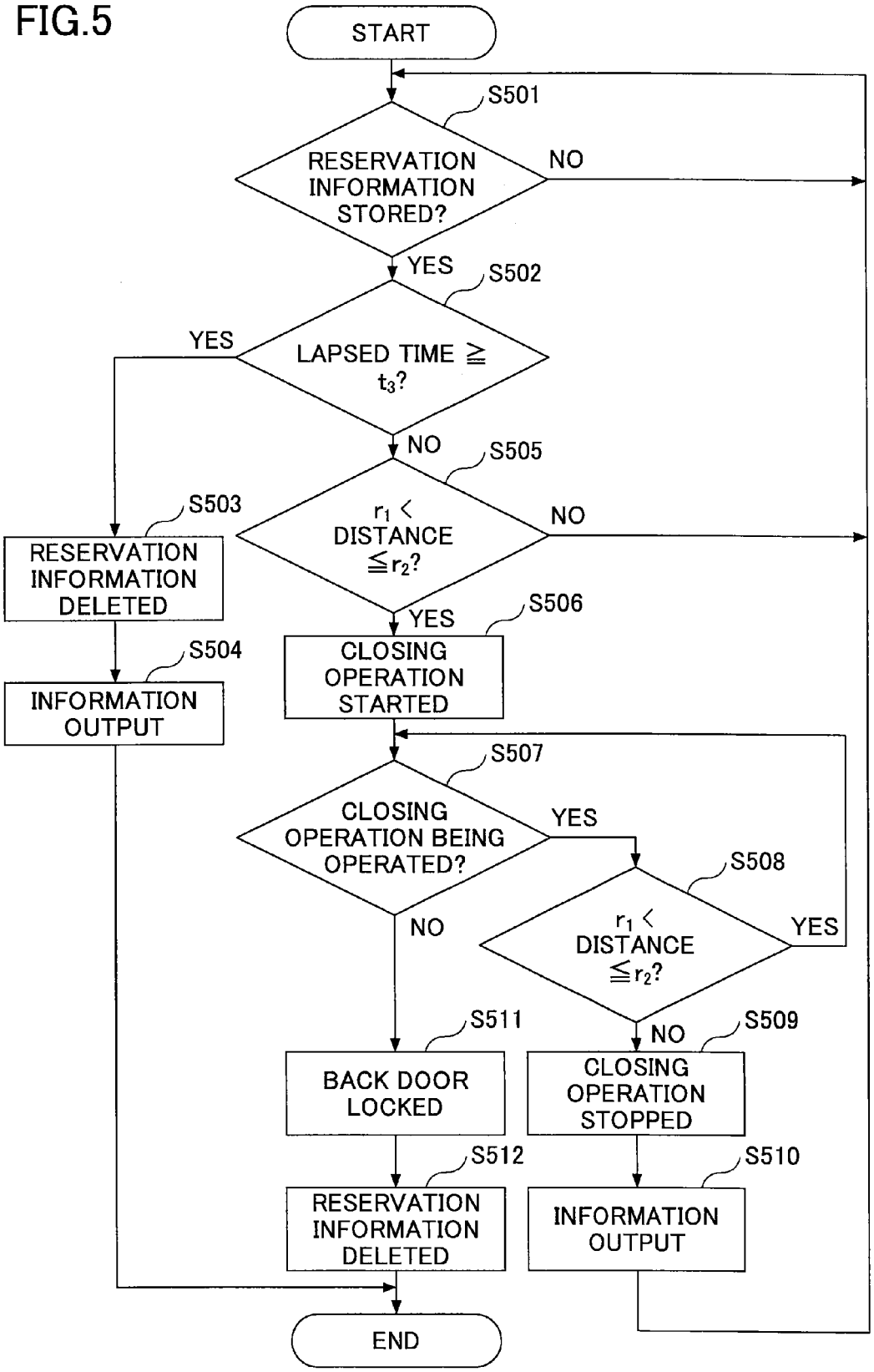
FIG. 5 is a flowchart of an example of a process executed by the back door ECU 11 with respect to a closing operation function.

FIG. 5 is a flowchart of an example of a process executed by the back door ECU 11 and related to the closing operation interruption function. The process illustrated in FIG. 5 is constantly performed by the back door ECU 11 during the period in which the back door is in the opened state, for example. It is noted that in a state in which the process illustrated in FIG. 5 is being performed, the smart ECU 10 causes the transmitter 21 to periodically transmit the detection signal to periodically output the determination result and the comparison result to the back door ECU 11. For this reason, the back door ECU 11 can use the latest determination result and the comparison result during the execution of the process illustrated in FIG. 5.

In step S501, the back door ECU 11 determines whether the reservation information storage part 11*a* stores the reservation information. If it is determined that the reservation information storage part 11*a* stores the reservation information, the process routine goes to step S502, otherwise the process routine starts from step S501 at the next process cycle.

In step S502, the back door ECU 11 determines whether a lapsed time from the timing when it is determined for the first time that the reservation information storage part 11*a* stores the reservation information is greater than or equal to a predetermined time t3 (an example of a third predetermined time). If the lapsed time from the timing when it is determined for the first time that the reservation information storage part 11*a* stores the reservation information is greater than or equal to the predetermined time t3, the process routine goes to step S503.

In step S503, the back door ECU 11 deletes the reservation information stored in the reservation information storage part 11*a*. With this arrangement, it becomes possible to prevent the reservation information from being stored for a long time (the predetermined time t3) after the user has had the reservation information stored in the reservation information storage part 11*a*. Thus, after the lapse of the predetermined time t3, it becomes possible to prevent the back door ECU 11 from causing the back door actuator 13 to perform the closing operation of the back door based on the reservation information. As a result of this, it becomes possible to suppress the problem that the closing operation of the back door is performed against to the intension of the user who forgets his/her having had the reservation information stored in the reservation information storage part 11*a* because of the lapse of the long time after that. When the process of step 503 is terminated, the process routine goes to step 504.

In step S504, the back door ECU 11 outputs the information to inform the user that the reservation information has been deleted with the information output device 17 (an example of a third information output part). As a result of this, when the reservation information is deleted, the user can understand the fact that the reservation information has been deleted.

In step S502, if it is determined that the lapsed time from the timing when it is determined for the first time that the reservation information storage part 11*a* stores the reservation information is not greater than or equal to a predetermined time t3, the process routine goes to step S505. In step S505, the back door ECU 11 determines whether the distance between the portable terminal 30 and the transmitter 21 is within a first predetermined range that is greater than the predetermined distance r1 and less than or equal to a predetermined distance r2. If the determination result input from the smart ECU 10 and concerning whether the portable terminal 30 exists in the detection area 80 indicates that the portable terminal 30 exists in the detection area 80, and the comparison result between the reception strength and the strength threshold indicates that the reception strength is less than the strength threshold, it means that the portable terminal 30 exists in the detection area 80*b*. In this case, the back door ECU 11 determines that the distance between the portable terminal 30 and the transmitter 21 is within the first predetermined range. Further, if the determination result input from the smart ECU 10 and concerning whether the portable terminal 30 exists in the detection area 80 indicates that the portable terminal 30 does not exist in the detection area 80, or if the determination result indicates that the portable terminal 30 exists in the detection area 80 and the comparison result between the reception strength and the strength threshold indicates that the reception strength is greater than or equal to the strength threshold, it means that the portable terminal 30 does not exist in the detection area 80*b*. In this case, the back door ECU 11 determines that the distance between the portable terminal 30 and the transmitter 21 is greater than the predetermined distance r1 and that the distance is not less than or equal to the predetermined distance r2. If it is determined that the distance between the portable terminal 30 and the transmitter 21 is within the first predetermined range, the process routine goes to step S506, otherwise the process routine starts from step S501 again at the next process cycle.

In step S506, the back door ECU 11 causes the back door actuator 13 to start the closing operation of the back door by driving the back door. With this arrangement, the user can implement the closing operation of the back door after putting the baggage in user's hands, even if the user cannot manually perform the closing operation of the back door due to the baggage in user's hands. Further, as described above, the distance between the portable terminal 30 and the transmitter 21 is less than or equal to the predetermined distance r1 and thus the user is relatively close to the back door when the reservation information is stored in the reservation information storage part 11*a* by the reservation function; however, the closing operation is started when the distance between the portable terminal 30 and the transmitter 21 is greater than the predetermined distance r1 and thus the user is relatively away from the back door, which ensures the safety of the user at the time of the closing operation of the back door. When the process of step 506 is terminated, the process routine goes to step 507.

In step S507, it is determined whether the closing operation of the back door is being performed. If it is determined that the closing operation of the back door is being performed, the process routine goes to step S508.

In step S508, the back door ECU 11 determines whether the distance between the portable terminal 30 and the transmitter 21 is within the first predetermined range. This process is the same as the process of step S505 and thus the explanation thereof is omitted. If it is determined that the distance between the portable terminal 30 and the transmitter 21 is within the first predetermined range, the process routine returns to step S507. In this case, the back door ECU 11 continues the closing operation of the back door based on the reservation information. On the other hand, if it is determined that the distance between the portable terminal 30 and the transmitter 21 is not within the first predetermined range, the process routine goes to step S509.

In step S509, the back door ECU 11 causes the back door actuator 13 to stop the closing operation of the back door by stopping the drive of the back door. As a result of this, when the user comes closer to the back door during the closing operation of the back door, the back door ECU 11 stops the closing operation of the back door upon the distance between the portable terminal 30 and the transmitter 21 being less than or equal to the predetermined distance r1 (an example of a second predetermined range), for example. Therefore, the safety for the user can be ensured. Further, even if the user cannot use his/her hands to stop the closing operation of the back door because of the baggage in his/her hands, etc., the user can stop the closing operation of the back door by entering the detection area 80*a*. Further, when the user picks up the baggage via the back door, puts the baggage in the detection area 80*b*, and returns to the detection area 80*a* to pick up more baggage via the back door, the closing operation of the back door is stopped, which matches the user's intention to pick up more baggage.

Further, if the user goes away from the back door, during the closing operation of the back door, up to the distance where the user cannot confirm the closing operation of the back door, the closing operation of the back door is stopped upon the distance between the portable terminal 30 and the transmitter 21 being greater than r2 (an example of the second predetermined range), for example. Thus, it becomes possible to suppress the closing operation of the back door at the position of the user where the user cannot confirm the closing operation of the back door. It is noted that, after the stoppage of the closing operation of the back door, the back door ECU 11 may hold the back door at an opening angle at the time of the stoppage, or may perform the opening operation of the back door. When the process of step 509 is terminated, the process routine goes to step 510.

In step S510, the back door ECU 11 causes the information output device 17 to output the information to inform the user that the closing operation of the back door is stopped. With this arrangement, the user can understand that the closing operation of the back door has been stopped.

In step S507, if it is determined that the closing operation of the back door is completed and thus the closing operation of the back door is not being performed, the process routine goes to step S511. In step S511, the back door ECU 11 requests the body ECU 12 to lock the back door. The body ECU 12 causes the door lock actuator 15 to lock the back door in response to the request. As a result of this, the user need not lock the back door after the completion of the closing operation of the back door. It is noted that locking the back door even before the back door becomes in a full closed state causes the back door to be in the locked state after the back door has been closed. Thus, the process of step S511 may be performed in step S506 or other steps. When the process of step 511 is terminated, the process routine goes to step 512.

In step S512, the back door ECU 11 deletes the reservation information stored in the reservation information storage part 11*a*.

According to the process illustrated in FIG. 5, if the reservation information storage part 11*a* stores the reservation information, the back door ECU 11 causes the back door actuator 13 to perform the closing operation of the back door upon the distance between the portable terminal 30 and the transmitter 21 being within the first predetermined range (step S506). Then, during the closing operation of the back door (step S507), the closing operation of the back door is stopped on the distance between the portable terminal 30 and the transmitter 21 being within the second predetermined range that is different from the first predetermined range (step S509). With arrangement, the closing operation of the back door can be appropriately stopped according to the distance between the portable terminal 30 and the transmitter 21 (i.e., the distance between the portable terminal 30 and the vehicle).

It is noted that, according to the process illustrated in FIG. 5, if the reservation information storage part 11*a* stores the reservation information, the back door ECU 11 causes the back door actuator 13 to perform the closing operation of the back door upon the distance between the portable terminal 30 and the transmitter 21 being within the first predetermined range (step S506). However, if the reservation information storage part 11*a* stores the reservation information, the back door ECU 11 may cause the back door actuator 13 to perform the closing operation of the back door upon the distance between the portable terminal 30 and the transmitter 21 being within the first predetermined range after the distance is less than or equal to the predetermined distance r1. Specifically, if the reservation information storage part 11*a* stores the reservation information, the back door ECU 11 may cause the back door actuator 13 to perform the closing operation of the back door upon the change in the position of the portable terminal 30 from the detection area 80*a* to the detection area 80*b*. Such a variant is suited for a case where the reservation information is stored in the reservation information storage part 11*a* using the back door close switch 14 other than the back door close switch 14 that is provided at the back door, such as the back door close switch 14 in the cabin.

Figure 6:
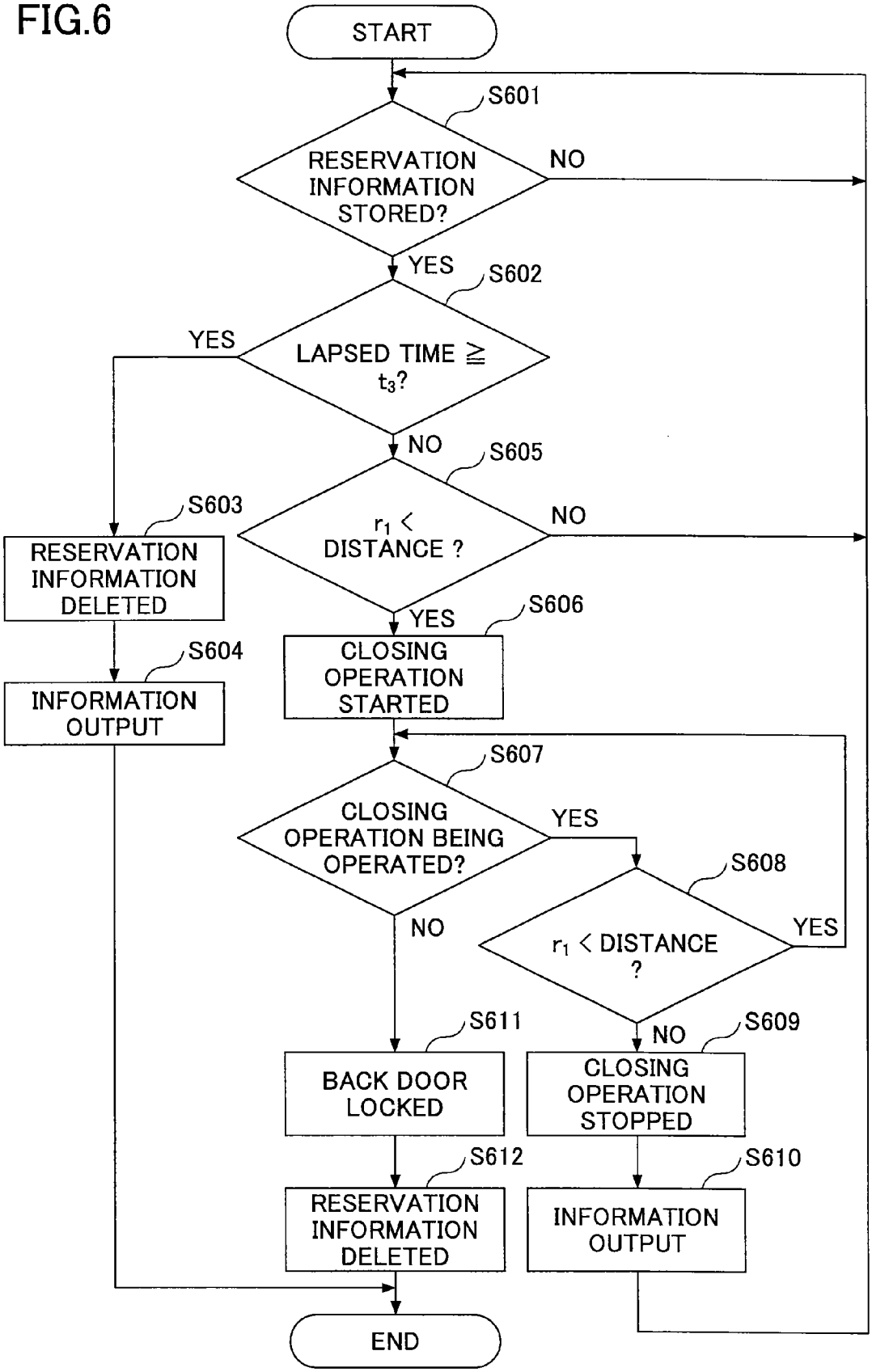
FIG. 6 is a flowchart of a variant of a process executed by the back door ECU 11 with respect to a closing operation function.

FIG. 6 is related to a variant of the process illustrated in FIG. 4, and a flowchart of example of a process executed by the back door ECU 11 and related to the reservation function.

The respective steps are the same as the respective steps in FIG. 5 except for step S605 and step S608.

In step S605, it is determined whether the distance between the portable terminal 30 and the transmitter 21 is greater than the predetermined distance (an example of the first predetermined range). If it is determined, based on the determination result input from the smart ECU 10 and concerning whether the portable terminal 30 exists in the detection area 80, and the comparison result between the reception strength and the strength threshold, that the portable terminal 30 exists in the detection area 80*b*, it is determined that the distance between the portable terminal 30 and the transmitter 21 is greater than the predetermined distance.

The process of step S608 is the same as the process of step S605.

As a result of this, when the user comes closer to the back door during the closing operation of the back door, the closing operation of the back door is stopped upon the distance between the portable terminal 30 and the transmitter 21 being less than or equal to the predetermined distance r1 (an example of a second predetermined range), for example. Thus, a problem is solved, which occurs when the user picks up the baggage via the back door and returns to pick up more baggage via the back door, for example, that the continuation of the closing operation of the back door interferes with the user who intends to pick up more baggage via the back door.

Further, as another variant, in the process illustrated in FIG. 6, in step S605 and step S606, it may be determined whether the distance between the portable terminal 30 and the transmitter 21 is greater than the predetermined distance r2. If the determination result concerning whether the portable terminal 30 exists in the detection area 80 indicates that the portable terminal 30 exists in the detection area 80, it is determined that the distance between the portable terminal 30 and the transmitter 21 is less than or equal to the predetermined distance r2. If the determination result concerning whether the portable terminal 30 exists in the detection area 80 indicates that the portable terminal 30 does not exist in the detection area 80, it is determined that the distance between the portable terminal 30 and the transmitter 21 is not less than or equal to the predetermined distance r2. According to the variant, the comparison result between the reception strength and the strength threshold is not required, and the calculation of the reservation information by the portable terminal 30 is not required.

Further, as another variant, in the process illustrated in FIG. 6, the process of step S605 may be the same as the process of step S505 illustrated in FIG. 5.

It is noted that, according to the process illustrated in FIG. 6, if the reservation information storage part 11*a* stores the reservation information, the back door ECU 11 causes the back door actuator 13 to perform the closing operation of the back door upon the distance between the portable terminal 30 and the transmitter 21 being greater than r2 (step S606). However, if the reservation information storage part 11*a* stores the reservation information, the back door ECU 11 may cause the back door actuator 13 to perform the closing operation of the back door upon the distance between the portable terminal 30 and the transmitter 21 being greater than r2 after the distance is less than or equal to the predetermined distance r1. Specifically, if the reservation information storage part 11*a* stores the reservation information, the back door ECU 11 may cause the back door actuator 13 to perform the closing operation of the back door upon the change in the position of the portable terminal 30 from the detection area 80*a* to the outside of the detection area 80. Such a variant is suited for a case where the reservation information is stored in the reservation information storage part 11*a* using the back door close switch 14 other than the back door close switch 14 that is provided at the back door, such as the back door close switch 14 in the cabin.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention. Further, all or part of the components of the embodiments described above can be combined.

For example, according to the embodiments described above, the distance between the portable terminal 30 and the transmitter 21 is regarded as the distance between the communication apparatus 20 and the portable terminal 30; however, the distance between the receiver 22 and the portable terminal 30 may be regarded as the distance between the communication apparatus 20 and the portable terminal 30. Specifically, the transmitter 21 transmits the detection signal to the portable terminal 30 via the detection antenna, and the portable terminal 30 calculates the reception strength of the detection signal with the processing device 32 to include the information related to the reception strength in the response signal, and the smart ECU 10 compares the strength of the detection signal received by the portable terminal 30 with the strength threshold; however, the portable terminal 30 may transmit the response signal to the receiver 22 without calculating the reception strength of the detection signal received by the portable terminal 30, and the smart ECU 10 may calculate the strength of the response signal received by the receiver 22 to compare the strength of the response signal with a strength threshold. In other words, the back door ECU 11 determines, based on the comparison between the strength of the response signal and the strength threshold whether the distance between the receiver 22 and the portable terminal 30 is within any predetermined ranges to implement the closing operation of the back door. In this case, the embodiments described above can be implemented by replacing the distance between the portable terminal 30 and the transmitter 21 with the distance between the receiver 22 and the portable terminal 30. Whether the distance between the vehicle and the portable terminal 30 is within any predetermined ranges can be determined with a simple configuration even if the strength of the response signal is compared with the strength threshold. It is noted, in this configuration, the reception strength is proportional to the distance between the receiver 22 and the portable terminal 30 such that the reception strength becomes smaller as the distance between the receiver 22 and the portable terminal 30 becomes greater. When the receiver 22 does not receive the detection signal, the reception strength is 0.

Further, for example, the embodiments described above are related to the back door; however, other doors are applicable. Specifically, a door on the driver seat side, a door on the passenger seat-side, or rear doors may be used as well.

Further, for example, in the embodiment described above, the back door close switch 14 is provided on the vehicle; however, the back door close switch 14 may be provided on the portable terminal 30, or may be provided on the vehicle and the portable terminal 30. In the configuration in which the back door close switch 14 is provided on the portable terminal 30, the reservation information storage part 11*a* may be provided in the portable terminal 30 as well.

Further, in the embodiments described above, the reservation information is generated by the successive operations on the back door close switch 14 to be stored in the reservation information storage part 11*a*; however, a way of generating and/or storing the reservation information in the reservation information storage part 11*a* is arbitrary. For example, a dedicated switch other than the back door close switch 14 may be provided. The reservation information may be generated and/or stored in the reservation information storage part 11*a* in response to a long pressing operation of the back door close switch 14, speech input, gesture input, etc. In other words, in the embodiments described above, as an example of the reservation means, the back door close switch 14 is used as an example of the reservation means (see FIG. 3), and the reservation means is implemented by the back door ECU 11 (see FIG. 4). However, the reservation means can be implemented in various manners as described above.

Further, in the embodiments described above, the first predetermined range and the second predetermined range are connected in a radius direction defined from a center of the transmitter 21 (i.e., the vehicle); however, a margin may be set between the first predetermined range and the second predetermined range. In other words, "being adjacent to" includes connecting via the margin.

The present application is based on and claims the benefit of priority of Japanese Priority Application No. 2014-162728, filed on Aug. 8, 2014, the entire contents of which are hereby incorporated by reference.

What is claimed is:

1. A vehicle control apparatus, comprising:

an actuator that is provided on a vehicle and is configured to perform a back door closing operation of the vehicle, the back door closing operation including moving a back door from a first position to a second position, wherein the back door is located behind a rear seat of the vehicle;

an input device configured to generate reservation information that identifies a reservation for the back door closing operation by the actuator;

a storage device configured to store the reservation information;

a portable terminal;

a communication apparatus that is provided on the vehicle and is configured to bi-directionally communicate with the portable terminal; and circuitry configured to:

cause, when the reservation information is stored in the storage device, the actuator to start the door back closing operation when a distance between the communication apparatus and the portable terminal is within a predetermined range having a maximum value and a minimum value, and cause, during the back door closing operation of the door, the actuator to stop the back door closing operation when the distance is not within the predetermined range and becomes at least one of a first distance and a second distance, wherein the first distance is greater than or equal to zero and less than or equal to the minimum value of the predetermined range, the second distance is greater than or equal to the maximum value of the predetermined range, the maximum value of the predetermined range corresponds to a distance at which an user confirms safe completion of the back door closing operation, and the input device is connected to the circuitry.

2. The vehicle control apparatus of claim 1, wherein the communication apparatus includes a transmitter and a receiver, the transmitter is configured to transmit a communication signal to an outside of the vehicle at a plurality of time points, the portable terminal is configured to receive the communication signal and transmit a response signal upon the reception of the communication signal, the receiver is configured to receive the response signal, and the circuitry is further configured to perform, based on a strength of the communication signal that the portable terminal receives or a strength of the response signal that the receiver receives, a determination whether the distance is within the predetermined range and a determination whether the distance becomes the at least one of the first distance and the second distance.

3. The vehicle control apparatus of claim 1, wherein the input device is further configured to generate the reservation information in response to a reservation operation by the user, and the storage device stores the reservation information when the back door is in an opened state and doors other than the back door are in a closed state.

4. The vehicle control apparatus of claim 3, further comprising:

an information output device configured to inform, when the reservation information is generated in a state where the doors other than the back door are not in the closed state, the user that the doors other than the back door are not in the closed state.

5. The vehicle control apparatus of claim 3, wherein the input device is a switch that is provided on the vehicle and operated to cause the back door closing operation, and the reservation operation is performed by the user pushing the switch and pushing the switch again within a first predetermined time thereafter.

6. The vehicle control apparatus of claim 1, wherein the input device is implemented by the circuitry, and the input device is configured to generate the reservation information upon a state of the distance within a range continuing for greater than or equal to a second predetermined time under a situation in which the back door is in an opened state and doors other than the back door are in a closed state, the range having a minimum value greater than or equal to zero and a maximum value less than or equal to a minimum value of the predetermined range.

7. The vehicle control apparatus of claim 1, further comprising:

an information output device configured to inform, when the storage device stores the reservation information, the user that the reservation information is stored.

8. The vehicle control apparatus of claim 1, wherein the storage device is configured to delete the reservation information upon the reservation information being stored in the storage device for greater than or equal to a third predetermined time, and the vehicle control apparatus further comprises an information output device configured to inform, when the reservation information is deleted, the user that the reservation information is deleted.

* * * * *